US005803458A

United States Patent [19]

Snyder

[11] Patent Number: 5,803,458

[45] Date of Patent: Sep. 8, 1998

[54] MEMORY MAZE GAME

[76] Inventor: Scott P. Snyder, 2593 W. Loma Vista Dr., Rialto, Calif. 92377

[21] Appl. No.: 915,458

[22] Filed: Aug. 20, 1997

[51] Int. Cl.[6] ..... A63F 3/00

[52] U.S. Cl. ..... 273/273; 273/284

[58] Field of Search ..... 273/273, 284, 273/139, 287

[56] References Cited

U.S. PATENT DOCUMENTS

| | | | |
|---|---|---|---|
| D. 245,436 | 8/1977 | Zelenko | D34/5 KK |
| 1,145,417 | 7/1915 | Hollien | 273/139 |
| 3,195,896 | 7/1965 | Markham | 273/273 |
| 3,677,548 | 7/1972 | Hincz | 273/273 |
| 4,270,754 | 6/1981 | Imatt | 273/273 |
| 4,465,283 | 8/1984 | Pilette et al. | 273/249 |
| 4,511,143 | 4/1985 | Sankrithi | 273/153 |
| 4,728,107 | 3/1988 | Dvorak | 273/273 |
| 4,817,957 | 4/1989 | Reeves | 273/248 |
| 5,108,111 | 4/1992 | Bilodeau | 273/249 |
| 5,333,878 | 8/1994 | Calhoun | 273/283 |

*Primary Examiner*—William M. Pierce
*Attorney, Agent, or Firm*—Goldstein & Associates

[57] ABSTRACT

A maze game, comprising a game board having a grid that defines a plurality of spaces. The spaces each have a colored dot, each dot either white, black, or red. The dots are covered by a playing piece during normal game play. The playing pieces each have a square base and a conical handle. Game play commences by having one player lift one of the playing pieces to reveal the dot beneath. If a black dot is revealed, the player replaces the playing piece and lifts another. If a white dot is revealed, the player replaces the playing piece and another player lifts one of the playing pieces. If a red dot is revealed, the player has won.

4 Claims, 1 Drawing Sheet

MEMORY MAZE GAME

BACKGROUND OF THE INVENTION

The invention relates to a memory maze game. More particularly, the invention relates to a game in which the game board is completely covered by game pieces, each piece selectively lifted to reveal a dot, the color of which being outcome determinative.

U.S. Pat. No. 4,465,283 to Pilette et al. discloses a maze type game board with alternately colored spaces.

U.S. Pat. No. 5,333,878 to Calhoun discloses a maze type board game. Calhoun employs a game board comprising a honeycomb of hexagonal spaces.

U.S. Pat. No. 4,817,957 to Reeves discloses a variable maze board game. In Reeves, a plurality of laterally and longitudinally oriented movable bars define a maze on a game board grid.

U.S. Pat. No. 4,511,143 to Sankrithi discloses an electronic maze game.

U.S. Pat. No. 5,108,111 to Bilodeau discloses a maze board game. Bilodeau discloses a board game having a plurality of pathways divided into spaces.

While these units may be suitable for the particular purpose employed, or for general use, they would not be as suitable for the purposes of the present invention as disclosed hereafter.

SUMMARY OF THE INVENTION

It is an object of the invention to produce a game in which the player is challenged to remember the location of colored dots on a game board.

It is another object of the invention that the colored dots are outcome determinative, in that they indicate what the player's next move is, whether they can move again, and whether they have won the game.

It is a further object of the invention that the colored dots are hidden during ordinary game play, one dot at a time is revealed by the player.

It is a still further object of the invention, the game board comprises a grid of spaces, each having a colored dot, and the dots are covered by game pieces.

The invention is a maze game, comprising a game board having a grid that defines a plurality of spaces. The spaces each have a colored dot, each dot either white, black, or red. Preferably, only one dot is present on the game board. The dots are covered by a playing piece during normal game play. The playing pieces each have a square base and a conical handle. Game play commences by having one player lift one of the playing pieces to reveal the dot beneath. If a black dot is revealed, the player replaces the playing piece and lifts another. If a white dot is revealed, the player replaces the playing piece and another player lifts one of the playing pieces. If a red dot is revealed, the player has won.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
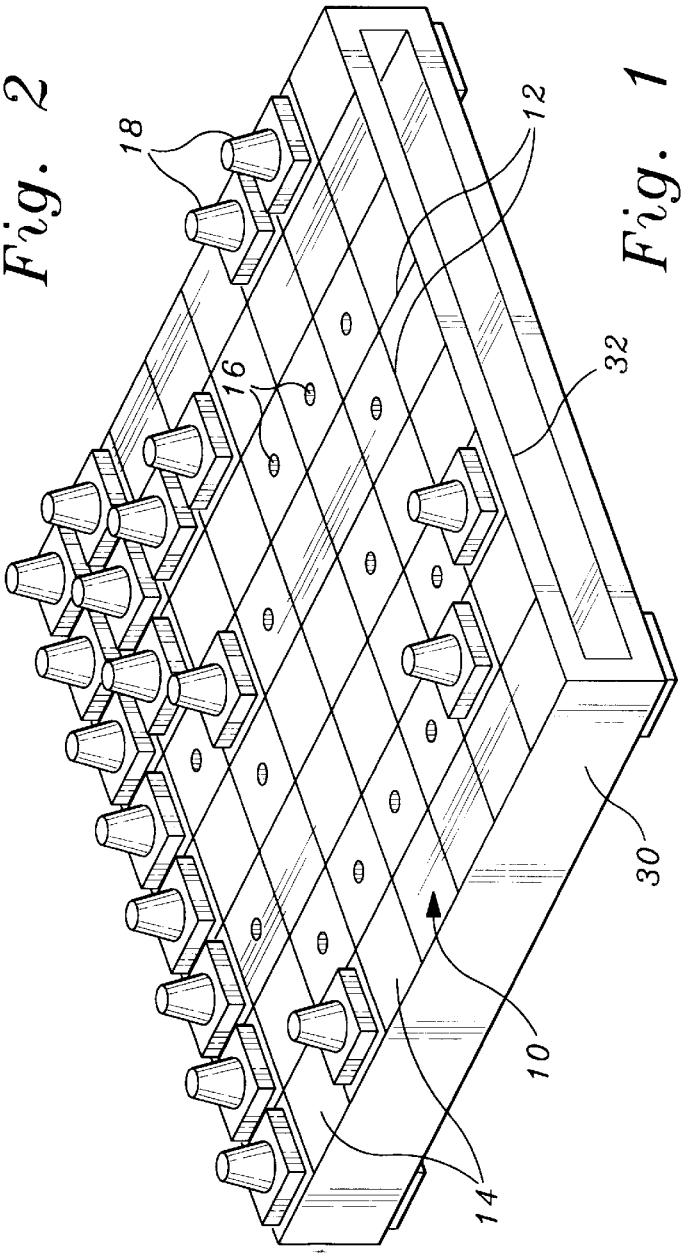
FIG. 1 is a diagrammatic perspective view of a game board, with most pieces removed to reveal the colored dots.

FIG. 1 illustrates a game board 10, comprising a grid 12, dividing the board into spaces 14. Preferably the grid 12 is a eight by eight arrangement, creating sixty four spaces 14. Each space 14 has a dot 16 centered therein.

The dots 16 are either colored red, black, or white. The color of the dot is outcome determinative, indicating to the player what the next move is. A black dot indicates that the player can move again. A red dot indicates that the player has won. A white dot causes the player to loose a turn, reverting play to another player. Typically, the majority of the dots is white, one dot is red, and the rest are black.

Figure 3:
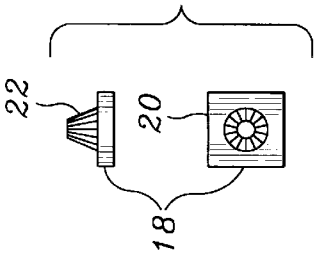
FIG. 3 illustrates game pieces shown from the front and above.

During normal play, all spaces 14 are covered by playing pieces 18. Referring to FIG. 3, the playing pieces 18 have a square base 20, which is substantially the same size as the space 14. A conical handle 22 extends upward from the base 20.

FIG. 1 depicts the game board 10 wherein the surface is partially covered with playing pieces 18. Most of the playing pieces 18 have been removed, to reveal a pattern of dots 16. The black dots are also shown in FIG. 1, spaces 14 which would have white dots are simply shown as white spaces.

Figure 2:
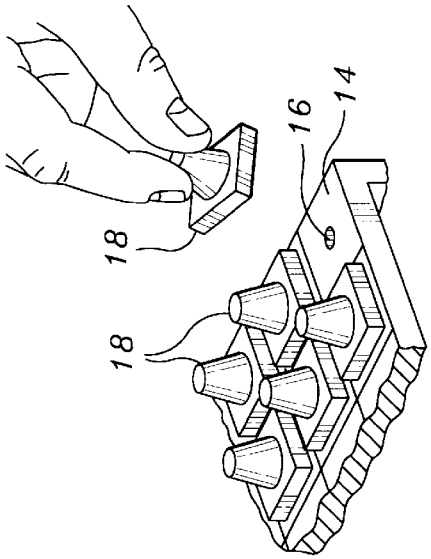
FIG. 2 is a diagrammatic perspective view with parts broken away, illustrating one piece being lifted during game play, to reveal the colored dot beneath.

As illustrated in FIG. 2, normal game play commences by having one player lift one of the playing pieces 18, revealing the dot 16 beneath. The dot 16 instructs the player about the next move. Once so instructed, the player recovers the dot 16 by replacing the playing piece 18 onto the space 14.

The game board can be constructed with a hollow base 30, having a slot 32 which extends fully beneath the game board. In this case, the dots 16 actually comprise holes which extend through the game board to the slot 32. A card having red, black, and white areas is placed in the slot 32, thus coloring the dots. The card is then easily replaceable, or even rotatable by ninety degrees, to challenge players who remember the pattern of dots on the game board.

What is claimed is:

1. A method of playing a maze game, using a game board having a grid defining a plurality of spaces, each space having a dot having a color selected from red, white, and black, further using playing pieces, each playing piece having a base for covering one of the spaces, comprising the steps of:

a) covering all of the spaces with one of the playing pieces;

b) lifting one of the playing pieces by one of the players to reveal the dot on the space that was covered by the playing piece; and then performing a step selected from:

c) repeating step (b) by the player if a black dot was revealed;

d) repeating step (b) by another player if a white dot was revealed;

e) deeming the player the winner of the game if a red dot is revealed.

2. The method of playing a maze game as recited in claim 1, wherein the step of lifting one of the playing pieces is immediately followed by replacing the playing piece to recover the space that was covered by the playing piece.

3. The method of playing a maze game as recited in claim 2, wherein one red dot is present on the game board.

4. The method of playing a maze game as recited in claim 3, wherein the game board comprises a hollow base having a slot for insertion of a card having red, white, and black colored areas and, wherein the dots comprise holes extending through the game board to the slot, the holes attain their color from the red, white, and black colored areas on the card in the slot, and wherein the method steps as previously recited are preceded by:

rotating the card ninety degrees in the slot.

* * * * *